United States Patent [19]

Flora

[11] Patent Number: 4,732,123

[45] Date of Patent: Mar. 22, 1988

[54] SAFETY AIR SUPPLY FOR DIESEL ENGINE SHUTDOWN SYSTEMS

[75] Inventor: William H. Flora, New Caney, Tex.

[73] Assignees: Stephen C. Ohm; Glen P. Johnson, both of Crosby, Tex. ; a part interest

[21] Appl. No.: 926,546

[22] Filed: Nov. 4, 1986

[51] Int. Cl.[4] ..... F02B 77/08

[52] U.S. Cl. ..... 123/198 DB; 123/377

[58] Field of Search ..... 123/316, 372, 373, 375, 123/377, 382, 383, 198 B, 198 DB, 379; 220/204; 141/4, 5

[56] References Cited

U.S. PATENT DOCUMENTS

| | | | |
|---|---|---|---|
| 3,548,798 | 12/1970 | Fleischer et al. | 123/379 |
| 3,937,257 | 2/1976 | Biro | 141/3 |
| 4,068,642 | 1/1978 | Little | 123/382 |
| 4,157,701 | 6/1979 | Holtrop et al. | 123/383 |
| 4,252,090 | 2/1981 | Baugh | 123/379 |
| 4,457,392 | 7/1984 | Caldwell et al. | 123/379 |

*Primary Examiner*—Ira S. Lazarus
*Assistant Examiner*—M. Macy
*Attorney, Agent, or Firm*—Kenneth A. Roddy

[57] ABSTRACT

A safety air supply for use in combination with pneumatic shutdown systems of the type connected to an existing air supply source and cooperative through electromechanical control means with the fuel injectors of Diesel engines for moving the fuel injectors between operative an inoperative positions. The safety device comprises an enclosed air reservoir tank connected between the air supply source and the air cylinder of the shutdown system by heavy duty armored conduit. A tee fitting is sealed in the top wall of the tank and a one-way check valve secured in the top of the tee fitting allows air to enter the tank from the existing source up to a predetermined pressure and thereafter closes to contain a supply of air within the tank independent from the existing source. The outlet of the tee fitting is connected to the inlet of the existing pneumatic shutdown system. In the event of a failure of the air source, or a ruptured or burned air line between the source and the pneumatic shutdown air cylinder, air will be supplied from the air tank to the shutdown air cylinder to maintain control whereby the fuel injectors may be moved to the neutral position or inoperative position.

12 Claims, 2 Drawing Figures

SAFETY AIR SUPPLY FOR DIESEL ENGINE SHUTDOWN SYSTEMS

BACKGROUND OF THE INVENTION

1. Field of the Invention

This invention relates generally to pneumatic safety devices for Diesel engines, and more particularly to a safety air supply for use in combination with pneumatic shutdown systems of the type connected to an existing air supply source and cooperative through electromechanical control means with the fuel injectors of Diesel engines for moving the fuel injectors between operative and inoperative positions.

2. Brief Description of the Prior Art

Safety devices for Diesel and other internal combustion engines are known in the art. Many trucks having diesel engines have a pneumatic "Shutdown" cylinder which moves the fuel injectors from an operative position to a neutral position. On some models, the shutdown cylinder is connected to the existing air compressor or air reservoir by plastic tubing. If the truck is involved in a wreck, turns over or catches on fire, the plastic tubing may be destroyed. In such cases, control of the shutdown cylinder is lost and the driver is unable to turn off the engine because the fuel injectors continue pumping.

One exemplary "shutdown system" for trucks is a device manufactured by Kysor of Cadillac, a division of Kysor Industrial Corporation, 1100 Wright St., Cadillac, Mich. 49601. The Kysor device comprises an operator controlled air valve connected to the existing air compressor which is bolted to the engine block and activates a lever connected to a rack to move the fuel injectors into and out of the firing position. When the injectors are retracted, fuel circulates back to the reservoir. The device is connected to the existing air compressor by plastic tubing which will easily melt in a fire or may become damaged by everyday usage. The air valve is actuated by the driver from inside the vehicle by pulling a lever which often is inoperative or stiff due to lack of use. The lever would also be difficult and dangerous to reach in the event of a fire or accident. When the plastic tubing is damaged, the injectors can not be moved out of the firing position and fuel continues circulating into the firing chambers. Should the injectors be locked out of the firing position, the engine can not be restarted.

There are several patents which disclose various safety devices for Diesel and other internal combustion engines. Most are directed toward valves installed between the fuel pump and the combustion chamber, or on the fuel pump to render the fuel pump inactive or to displace the fuel with air to stop the engine.

Santschi, U.S. Pat. No. 2,095,349 discloses a safety device for engines which operates in a manner similar to a governor. A rotary element of a safety stop mechanism contains a tripping arm and has a finger which extends outward upon sufficient centrifugal force to open a valve allowing air to flow from a source to displace fuel from the fuel pump. The device stops the engine by terminating the fuel feed responsive to engine speed in excess of the normal speed of the engine.

Rachuig, U.S. Pat. No. 2,714,290 discloses a control device for shutting down one or more internal combustion engines simultaneously in an emergency. The device is particularly designed for pipe line operations where engines were arranged in a pump house. An air intake line has a first pressure responsive valve arranged therein and a feed line connected to a source of fuel and to the engine has a second pressure responsive valve located therein. The two valves are connected to a source of pressure to maintain them in an open position. Remote quick release valves located in the pressure supply line release pressure from the first and second valves to close them sequentially in reverse order responsive to the opening of the quick release valve.

Metzger, U.S. Pat. No. 2,714,883 discloses a pneumatic starting and shutdown system for engines upon failure of any one of the various parts of the engine unit beyond the safe limits of operation, such as a drop in oil pressure, an increase in water jacket temperature, an increase in engine speed, a loss in supply air pressure, etc., and primarily to cut off the supply of fuel to the engine, and whereby the engine cylinders will be thoroughly scavenged of residual gases upon restarting the engine.

Grondel et al, U.S. Pat. No. 3,760,784 discloses an emergency stop device for engines. A bottle of gas under pressure and closed by a diaphragm is received in a hollow body connected through a check valve to the fuel delivery pipe of an internal combustion engine at a point between the reservoir and injection pump downstream of a second check valve. The housing contains a mechanism to pierce the diaphragm in case of an accident to send a charge of the gas into the fuel delivery pipe and in the supply chamber of the injection pump to expel fuel therefrom towards the reservoir through a scavenging valve and thus causing the engine to stop.

Clemens et al, U.S. Pat. No. 4,361,121 discloses a control device for shutting of a Diesel engine. The device includes a supply pump and a reversal valve. The reversal valve in the stop position connects the suction chamber with the intake side of the supply pump and connects the compresssion side of the supply pump with the fuel tank. A check valve is provided in the fuel line between the supply pump and the fuel filter which is disposed to open toward the filter. Another check valve comprising an overflow valve determining the suction line pressure is provided in an overflow line leading from the suction chamber to the fuel tank. When the reversal valve is actuated by an electromagnet, a similar key-actuated shutoff to that known in gasoline engines can also be effected in Diesel engines.

The present invention is distinguished over the prior art in general, and these patents in particular by a safety air supply for use in combination with pneumatic shutdown systems of the type connected to an existing air supply source and cooperative through electromechanical control means with the fuel injectors of Diesel engines for moving the fuel injectors between operative and inoperative positions. The safety device comprises an enclosed air reservoir tank connected between the air supply source and the air cylinder of the shutdown system by heavy duty armored conduit. A tee fitting is sealed in the top wall of the tank and a one-way check valve secured in the top of the tee fitting allows air to enter the tank from the existing source up to a predetermined pressure and thereafter closes to contain a supply of air within the tank independent from the existing source. The outlet of the tee fitting is connected to the inlet of the existing pneumatic shutdown system. In the event of a failure of the air source, or a ruptured or burned air line between the source and the pneumatic shutdown air cylinder, air will be supplied from the air tank to the shutdown air cylinder to maintain control whereby the fuel injectors may be moved to the neutral position or inoperative position.

SUMMARY OF THE INVENTION

It is therefore an object of the present invention to provide a safety air supply for Diesel engines of the type having shutdown systems cooperative with the fuel injectors.

It is another object of this invention to provide a safety air supply for Diesel engines of the type having shutdown systems which will become operational in the event of failure of the air supply to the shutdown system.

Another object of this invention is to provide a safety air supply for Diesel engines of the type having shutdown systems which become operational in the event of damage or destruction of the existing shutdown system air supply lines by fire or accident.

A further object of this invention is to provide a safety air supply for Diesel engines of the type having shutdown systems which may be easily and quickly installed as auxillary equipment and does not require expensive modification to existing engine components or accessories.

A still further object of this invention is to provide a safety air supply for Diesel engines of the type having shutdown systems which is simple in operation, economical to manufacture, and rugged and durable in use.

Other objects of the invention will become apparent from time to time throughout the specification and claims as hereinafter related.

The above noted objects and other objects of the invention are accomplished by the present safety air supply for use in combination with pneumatic shutdown systems of the type connected to an existing air supply source and cooperative through electromechanical control means with the fuel injectors of Diesel engines for moving the fuel injectors between operative and inoperative positions. The present invention, in the event of a failure of the air source, or a ruptured or burned line air line between the source and the pneumatic shutdown air cylinder, will supply air from the air tank to the shutdown air cylinder to maintain control whereby the fuel injectors may be moved to the neutral position or inoperative position.

DESCRIPTION OF THE PREFERRED EMBODIMENT

Figure 1:
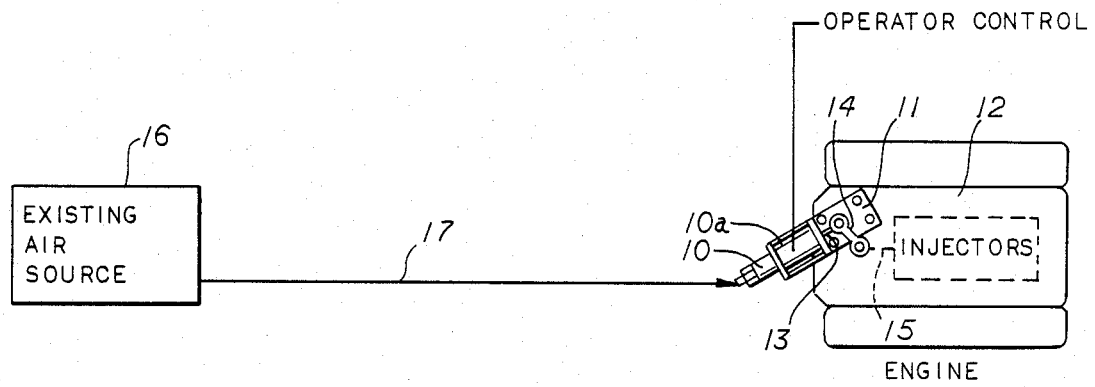
FIG. 1 (PRIOR ART)
FIG. 1 is a schematic illustration of a conventional Diesel engine injector shutdown system of the prior art.

Referring to the drawings by numerals of reference, there is shown in FIG. 1, a schematic illustration of a conventional "shutdown" system of the prior art. An air cylinder 10 having an electromechanical control valve 10*a* is secured to bracket 11 attached to the engine block 12. A retractable plunger 13 extends outward from one end of the cylinder to contact the upper portion of a lever 14 pivotally mounted on the engine block. A rod or rack 15 inside of the engine (not shown) is connected to the fuel injectors. Movement of the rod or rack 15 causes the fuel injectors to move either in or out of the firing position. The cylinder 10 is connected to the existing air compressor 16 by tubing 17. Most prior art devices utilize plastic tubing for connection to the air compressor. The cylinder 10 is actuated by the driver from inside the vehicle either electrically or mecanically by throwing a switch or lever to move the fuel injectors into and out of the firing position. When the injectors are retracted, fuel circulates back to the reservoir.

The plastic tubing 17 used by prior art devices will easily melt in a fire or may become damaged by everyday usage. When the plastic tubing is damaged, the injectors can not be moved out of the firing position and fuel continues circulating into the firing chambers. Should the injectors be locked out of the firing position, the engine can not be restarted. The switch or lever used by the driver to actuate the air cylinder is often inoperative or stiff due to lack of use. The switch or lever would also be difficult and dangerous to reach in the event of a fire or accident.

Figure 2:
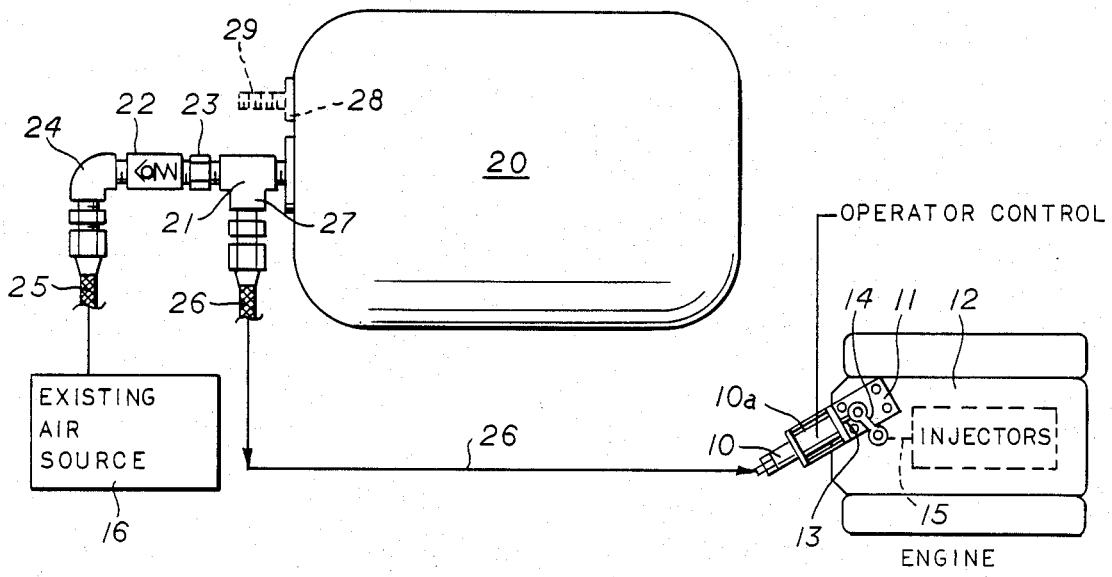
FIG. 2 is a side elevational view of the safety air supply in accordance with the present invention shown connected schematically in the existing system.

The invention as shown in FIG. 2 is a safety air supply for Diesel engines or other internal combustion engines of the type having shutdown systems cooperative with the fuel injectors. The apparatus of the present invention comprises a small sealed heavy walled air tank 20 capable of containing a minimum air pressure of 120 p.s.i. The size of the preferred tank is approximately 4 inches in diameter and 6 inches long and may be installed by conventional means at a convenient location on the engine block or in the engine compartment. A tee fitting 21 is secured and sealed in the top wall of the tank 20. A one-way check valve 22 is secured in the top of the tee fitting 21. The one-way check valve 22 is positioned to allow air to only enter the the tank 20. A nipple 23 may be installed between the tee fitting 21 and the check valve 22.

An ell fitting 24 secured in the check valve inlet is connected to the existing air supply or compressor 16 by heavy duty armored steel conduit 25. Heavy duty armored conduit 26, such as Steelflex metal hose connects the outlet 27 of the tee fitting 21 to the inlet of the existing shutdown air cylinder 10. Thus the apparatus of the present invention is installed between the air source or compressor 16 and the fuel injector shutdown air cylinder 10.

As previously described, the conventional shutdown air cylinder 10 having electromechanical control means 10*a* is secured to a bracket 11 attached to the engine block 12. A retractable piston rod or plunger 13 extends outward from one end of the cylinder to contact the upper portion of a crank lever 14 pivotally mounted on the engine block. A rod or rack 15 inside of the engine (not shown) is connected to the fuel injectors and actuated by the crank lever 14. Rotation of the crank lever 14 moves the rod or rack 15 which in turn causes the fuel injectors to move either in or out of the firing position. The cylinder 10 is connected to the existing air compressor 16 by tubing 17. Most prior art devices utilize plastic tubing for connection to the air compressor. The cylinder 10 is actuated by the driver from inside the vehicle either electrically or mechanically by throwing a switch or lever to move the fuel injectors into and out of the firing position.

Optionally, as shown in dotted line, an inlet 28 may be provided in the top wall of the tank 20 and a conventional air fill valve 29 secured therein. This option allows the tank 20 to be filled at any convenient service station and would make the tank non dependent upon filling by the air compressor.

Once the compressor has been initially started, the tank 20 will be filled to approximately 120 p.s.i. After reaching the predetermined tank pressure, air will then be directed from the compressor 16 through the ell 24 via conduit 25, unseating the check valve 22, out through the tee fitting 21, and through the conduit 26 to the inlet of the shutdown air cylinder 10.

Having thus described the invention for use with an existing shutdown system, it should be understood that a modified embodiment of the invention may be used to replace existing shutdown systems, or on vehicles not equipped with a shutdown system.

Referring again to FIG. 2, such a modification comprises an air cylinder 10 having electromechanical control means such as a solenoid valve 10*a* secured to a bracket 11 attached to the engine block 12. A retractable piston rod or plunger 13 extends outward from one end of the cylinder and is connected to one end of a crank lever 14 pivotally mounted on the engine block. A rod or rack 15 inside of the engine (not shown) is connected to the fuel injectors and actuated by the crank lever 14. Rotation of the crank lever 14 moves the rod or rack 15 which in turn causes the fuel injectors to move either in or out of the firing position. The inlet of the cylinder 10 is connected to the air reservoir tank 20 by heavy duty armored conduit 26.

The reservoir tank of the modified embodiment may utilize the existing air compressor, or may be filled with the optional fill valve 29 shown in dotted line, at any convenient service station.

Once the reservoir tank 20 has been pressurized to approximately 120 p.s.i., the check valve will close to contain the pressurized air. The solenoid valve 10*a* is actuated by the driver from inside the vehicle by throwing a switch. Actuation of the solenoid valve 10*a* allows air to then be directed from the reservoir tank 20 through the tee fitting 21, and through the conduit 26 to the inlet of the air cylinder 10 to move the piston 13. Movement of the piston rotates the crank lever 14 which in turn moves the crank 15 to move the fuel injectors into and out of the firing position.

Although not shown, it should be understood that the solenoid valve member could be connected directly with, or adjacent to the check valve member at end of the reservoir tank.

OPERATION

The operational sequence will be described with reference to the embodiment for use with an existing shutdown system. In the event of a failure of the air source or compressor 16, or a ruptured or burned line between the source or compressor and the shutdown air cylinder 10, the air pressure contained within the tank 20 will be greater than the pressure maintaining the check valve open. The check valve 22 will then move to the closed (inlet) position and air from the tank under pressure will travel from the tank to the inlet of the air cylinder 10 through the tee fitting 21 and conduit 26.

In this manner, the fuel injectors will automatically be moved to the inoperative or non-firing neutral position allowing the fuel to be circulated back to the fuel tank and reducing the hazard caused by loss of control of the fuel injectors. In the event that the electrical system is not damaged, the safety air supply of the present invention will allow the injectors to be moved back to the operative or firing position to restart the vehicle. A tank of the size and pressure previously described will supply sufficient air to enable the injectors to be moved in and out of firing position approximately thirty times.

While this invention has been described fully and completely with special emphasis upon a preferred embodiment, it should be understood that within the scope of the appended claims the invention may be practiced otherwise than as specifically described herein.

I claim:

1. In combination with pneumatic shutdown systems of the type having an air cylinder connected to an existing air supply source and with the fuel injectors of Diesel engines and having electromechanical operator control means such as a solenoid valve controlled remote from the engine compartment for controlling the air from the source to selectively move the fuel injectors between operative and inoperative positions, a safety device comprising;

an enclosed air reservoir tank capable of being pressurized, and air control means on said reservoir tank connected to the existing air supply source including one-way valve means operative to allow air from said source to enter said reservoir tank up to a predetermined pressure and thereafter maintaining a pressurized supply of air contained within said reservoir tank independent from the existing source and outlet means between the valve means and said reservoir tank connected to the inlet of the air cylinder of the existing pneumatic shutdown system, said one-way valve means closing upon loss of air from said source and allowing the contained pressurized air in said reservoir tank to be directed through said outlet means to the inlet of the air cylinder of the existing pneumatic shutdown system thereby automatically supplying sufficient air pressure to operate the air cylinder of the existing pneumatic shutdown system upon failure of the existing air supply source or the existing operator control means.

2. A safety device according to claim 1 including;

heavy duty armored conduit having fittings at each end, said conduit connected between the existing air supply source and the inlet of said air control means and between the outlet of said air control means and the inlet of the air cylinder of the existing pneumatic shutdown system.

3. A safety device according to claim 1 wherein;

said valve means operative to close communication between said existing air supply source and said tank upon said tank pressure reaching 120 pounds per square inch.

4. A safety device according to claim 1 including;

an auxiliary one-way air fill valve installed on said tank for filling said tank independently of the existing air supply source.

5. A safety device according to claim 1 in which said air control means comprises;

a tee fitting secured and sealed in the wall of said tank, an ell fitting secured and sealed in the top of said one-way check valve and connected to the existing air supply source, and the outlet of said tee fitting connected to the inlet of the air cylinder of the existing pneumatic shutdown system.

6. A pneumatic shutdown system for use on Diesel engines for moving the fuel injectors between an operative position and an inoperative position comprising;

an air cylinder having a movable piston operatively connected to the fuel injectors of the engine whereby movement of the piston causes movement of the fuel injectors between an operative firing position and an inoperative nonfiring position, an enclosed air reservoir tank capable of being pressurized to contain a supply of pressurized air, air control means on said reservoir tank including one-way valve means operative to allow air to enter said tank up to a predetermined pressure and thereafter maintaining a pressurized supply of air contained within said tank, and outlet means connected to the inlet of the air cylinder for moving the piston.

operator control means for selectively moving said valve means to an open position allowing the contained pressurized air in said tank to be directed through said outlet means to the inlet of the air cylinder of the existing pneumatic shutdown system thereby supplying sufficient air pressure to move the piston, said operator control means comprising a solenoid valve cooperative with said air control means and controlled remote from the engine compartment for selectively releasing the contained pressurized air in said tank to the inlet of the air cylinder, and the movement of said piston causing movement of the fuel injectors between an operative firing position and an inoperative nonfiring position.

7. A pneumatic shutdown system according to claim 6 including;

heavy duty armored conduit having fittings at each end and connected between the outlet of said air control means and the inlet of said air cylinder.

8. A pneumatic shutdown system according to claim 6 wherein;

said valve means operative to close communication between said existing air supply source and said tank upon said tank pressure reaching 120 pounds per square inch.

9. A pneumatic shutdown system according to claim 6 including;

an auxiliary one-way air fill valve installed on said tank for filling said tank.

10. A pneumatic shutdown system according to claim 6 including;

a crank lever having one end connected to the piston of said air cylinder and the other end operatively connected to a rack member movably disposed within the engine, said rank member connected to the fuel injectors and actuated by the crank lever whereby rotation of said crank lever in one direction moves said rack member causing the fuel injectors to move to an inoperative nonfiring position and rotation in another direction causing the fuel injectors to move to an operative firing position.

11. A pneumatic shutdown system according to claim 6 in which said air control means comprises;

a tee fitting secured and sealed in the wall of said tank and the outlet of the tee fitting connected to the inlet of said air cylinder, and a one-way check valve secured in the top of the tee fitting and operative to allow air to enter said tank up to a predetermined pressure and thereafter closing to contain a supply of air within said tank independent from the existing source.

12. A pneumatic shutdown system according to claim 6 in which said air control means comprises;

a tee fitting secured and sealed in the wall of said tank and the outlet of the tee fitting connected to the inlet of said air cylinder, and a one-way check valve secured in the top of the tee fitting and operative to allow air to enter said tank up to a predetermined pressure and thereafter closing to contain a supply of air within said tank independent from the existing source.

* * * * *